United States Patent [19]

Bruckmann et al.

[11] Patent Number: 4,643,768

[45] Date of Patent: Feb. 17, 1987

[54] INOCULANT ALLOY BASED ON FERROSILICON OR SILICON AND PROCESS FOR ITS PREPARATION

[75] Inventors: Heinz Bruckmann; Friedrich Wolfsgruber, both of Tacherting; Ernst A. Weiser, Unterneukirchen, all of Fed. Rep. of Germany

[73] Assignee: SKW Trostberg Aktiengesellschaft, Trostberg, Fed. Rep. of Germany

[21] Appl. No.: 774,323

[22] Filed: Sep. 10, 1985

[30] Foreign Application Priority Data

Sep. 13, 1984 [DE] Fed. Rep. of Germany ..... 3433610

[51] Int. Cl.[4] ..... C22C 33/08

[52] U.S. Cl. ..... 420/578; 420/590

[58] Field of Search ..... 75/130 R; 420/578, 590

[56] References Cited

U.S. PATENT DOCUMENTS

| | | | |
|---|---|---|---|
| 2,490,818 | 12/1949 | Kuniansky | 75/130 R |
| 2,676,097 | 4/1954 | Strauss | 75/130 R |
| 2,750,284 | 6/1956 | Ihrig | 75/130 R |
| 3,137,570 | 6/1964 | Mickelson | 75/130 R |
| 3,151,975 | 10/1964 | Madaras | 75/130 R |

*Primary Examiner*—Peter D. Rosenberg

*Attorney, Agent, or Firm*—Felfe & Lynch

[57] ABSTRACT

An inoculant alloy based on ferrosilicon or silicon for the manufacture of cast iron with lamellar, compact or spheroidal graphite is described, this alloy comprising (a) between 0.1 and 10% of barium and/or zirconium, (b) less than 2% of aluminum and (c) 0.3% of calcium.

This inoculant alloy is distinguished by particularly good suppression of the precipitation of carbide and by its preparation process which is industrially simple and thus has favorable costs.

6 Claims, No Drawings

INOCULANT ALLOY BASED ON FERROSILICON OR SILICON AND PROCESS FOR ITS PREPARATION

The present invention relates to an inoculant alloy based on ferrosilicon or silicon for the manufacture of cast iron with lamellar, compact or spheroidal graphite, and to a process for its preparation.

In addition to silicon, cast iron contains carbon in a quantity from about 2 to 4% as the main alloying element. In addition of certain modifying alloys, such as, for example, FeSiMg, FeSiTi, FeTi or pure metals, such as, for example, magnesium, makes it possible to convert the carbon into compact or spheroidal graphite. This graphite present in different forms has a very pronounced effect on the strength, toughness and thermal conductivity of the cast iron. It is known to improve these properties, by adding inoculant alloys additionally, which act as nucleating agents. In the case of an unduly small number of nucleating agents and/or a correspondingly rapid cooling rate of the molten iron, the intermetallic compound $Fe_3C$, also called carbide or cementite, freely precipitates preferentially, and this has an increasingly adverse effect on the properties of the cast iron. The precipitation of these carbides can be prevented by an addition of inoculant alloys immediately before the cast iron is teemed off.

The actual active inoculant substances, such as, for example, Ca, Al, Mg, Zr and Ba are contained in most of the known inoculant alloys in ferrosilicon. The calcium content being 1–3% and the aluminum content being 1–2%, since calcium and aluminum influence the effect of the other elements in a positive way.

DE-AS No. 1,433,429 has disclosed inoculant alloys based on ferrosilicon, which contain strontium in a quantity of 1 to 4% as the active inoculant substance. The disadvantages of the hitherto known inoculant alloys are that the suppression of the precipitation of carbide is not yet satisfactory and that the industrial processes for their preparation are in most cases expensive.

The underlying object of the invention is therefore to develop an inoculant alloy, based on ferrosilicon or silicon, for the manufacture of cast iron with lamellar, compact or spheroidal graphite, which alloy does not have the above disadvantages of the known inoculant alloys or does not show them to such an extent.

According to the invention, this object is achieved by an inoculant alloy comprising (a) between 0.1 and 10% of barium and/or zirconium, (b) less than 2.0% of aluminum and (c) less than 0.3% of calcium.

It has been found, surprisingly, that the inoculant alloy according to the invention effectively suppresses the precipitation of carbide, in spite of the aluminum and calcium contents being very low. This was not foreseeable for the reason that it has hitherto been assumed that aluminum and calcium have a positive influence on the effect of the elements barium and zirconium.

The content of barium and/or zirconium lies preferably in the range of 0.4 to 1.5%. With a content of less than 0.1% of these elements, the effect of the alloy diminishes very sharply, whereas above 10% no further improvement can be achieved. It is to be regarded as essential to the invention that the aluminum and calcium contents are as low as possible. The aluminum content lies preferably below 1.0%, whereas the calcium content lies preferably below 0.1%.

According to the invention, it is not absolutely necessary that the alloy constituents barium and/or zirconium are present in the metallic form in the alloy; instead, they can also be present in part in a non-metallic or oxidic form, for example, without negative results with respect to the nucleating effect being detectable. This has direct consequences for the preparation of the alloy according to the invention, which can be prepared industrially in a simple manner, just by introducing a barium and/or zirconium compound into the molten ferrosilicon or silicon. Even though it is favourable it is not absolutely necessary to introduce a reducing agent into the melt at the same time. As a result, the process becomes very uncomplicated and hence also has very favorable costs. Even though it is expected that a part of the non-metallic barium and/or zirconium compounds introduced into the ferrosilicon or silicon melt is reduced by metallic reducing agents present, such as, for example, calcium and aluminium, nevertheless the predominant part of these compounds will be present in a non-metallic form in the alloy.

As the barium and zirconium compounds, all compounds of these elements are in principle suitable. Oxygenated compounds of barium and zirconium have proved to be particularly advantageous, the carbonate, oxide, hydroxide or sulfate being employed in particular. The quantity of the compounds employed depends solely on the desired barium and/or zirconium content in the alloy.

If it is desired, for certain reasons, to set the content of metallic barium and/or zirconium in the alloy as high as possible, it is preferred to use a reducing agent additionally to the barium or zirconium compound. Suitable reducing agents are the conventional carbonaceous compounds, such as calcium carbide or graphite, in the same way as the metallic or metal-containing alkaline earth compounds, such as calcium, magnesium, calcium-silicon or ferrosilicon-magnesium. The weight ratio of barium and/or zirconium compounds to the reducing agent depends on the desired content of barium or zirconium metal in the inoculant alloy to be made. The reducing agent is being employed as a rule in a stoichiometric or less than stoichiometric quantity.

According to a further embodiment of the invention even without a reducing agent, a relatively high content of metallic barium and/or zirconium in the alloy can be adjusted by using master alloy consisting of preferably 5–40% of metallic barium and/or zirconium, this alloy being added to the ferrosilicon or silicon melt.

The inoculant alloy can be prepared in conventional equipment, such as, for example, an induction furnace or arc furnace.

The advantages of the inoculant alloy, according to the invention, which is added to the cast iron in quantities of 0.05 to 1% by weight, relative to the cast iron, are good nucleating properties and hence good suppression of the precipitation of carbide, and their industrially simple preparation at favorable costs.

The examples which follow are intended to illustrate the invention in more detail.

EXAMPLE 1

3.3 kg of FeSi 75, 1.4 kg of steel scrap and 4.7 kg of silicon were melted down in a coreless induction furnace of 10 kg capacity. 240 g of $BaCO_3$, mixed with 80 g of $CaC_2$, were then added to the molten FeSi 75.

The subsequently crushed raw material gave the following analysis:

% Si: 74.2
% Fe: 24.1
% Ba: 0.59
% Al: 0.17
% Ca: 0.14

This alloy was compared in a foundry with the FeSiSr alloy of the following composition Fe: 23.3
Sr: 0.8
Si: 75.0
Ca: 0.08
Al: 0.35 in accordance with the following scheme:

The transport ladle was charged from the induction furnace with 1 ton of cast iron with lamellar graphite. 250 kg are then transferred in each case into the casting ladle. Alternatively, FeSiSr or the FeSiBa alloy according to the invention can then be added to the casting jet during the charging process. The added quantity was 0.3 percent by weight and the iron temperature was about 1400° C.

Immediately after the addition, a so-called chilling or quenching sample, cast against a copper plate, was taken and the carbide precipitation was compared and measured in mm.

Ladle 1:
FeSiBa: 3 mm
FeSiSr: 3 mm
untreated: 10 mm

Ladle 2:
FeSiBA: 3 mm
FeSiSr: 5 mm

EXAMPLE 2

Four samples of 9.5 kg of FeSi 75 each were melted down in the coreless induction furnace of 10 kg capacity. 500 g of $BaCO_3$ and 35 g of graphite were added to this melt.

The raw material was crushed to 0.8–10 mm and analysed:

| | 1 | 2 | 3 | 4 |
|---|---|---|---|---|
| % Si | 77.9 | 77.3 | 77.7 | 77.5 |
| % Al | 0.77 | 0.56 | 0.67 | 0.61 |
| % Ca | 0.15 | 0.08 | 0.12 | 0.09 |
| % Ba | 0.7 | 0.7 | 0.7 | 0.6 |
| % Fe | remainder | remainder | remainder | remainder |

As described under Example 1, the chilling samples and chilling curves showed that all the melts exhibited good suppression of carbide precipitation, particularly good results being obtained with samples 2 and 4.

EXAMPLE 3

Three samples a, b, c of FeSi 75 melts were prepared in the coreless induction furnace of 10 kg capacity.

Thereafter the following inoculant alloys were then stirred in:

| sample | inoculant alloy |
|---|---|
| a | 400 g of $BaCO_3$, together with 133 g of $CaC_2$, |
| b | 313 g of FeSiZr 35, |
| c | 160 g of $BaCO_3$, 54 g of $CaC_2$ and 125 g of FeSiZr 35. |

The raw material was then crushed and analysed:

| | a FeSiBa | b FeSiZr | c FeSiBaZr |
|---|---|---|---|
| % Al | 0.39 | 0.40 | 0.44 |
| % Ca | 0.19 | 0.04 | 0.10 |
| % Si | 73.6 | 73.2 | 74.3 |
| % Fe | 24.0 | 24.5 | 23.5 |
| % Ba | 1.1 | — | 0.35 |
| % Zr | — | 1.1 | 0.52 |

Samples of the cast iron were taken as described under Example 1, and the carbide formation was measured:

| | | |
|---|---|---|
| Ladle 1 | Sample a | 7 mm |
| | Sample a | 7 mm |
| Ladle 2 | Sample b | 5 mm |
| | Sample b | 3 mm |
| Ladle 3 | Sample c | 2 mm |
| Ladle 4 | Sample c | 3 mm |
| | Sample c | 4 mm |

EXAMPLE 4

Two samples of FeSi 75 were melted down in the coreless induction furnace of 10 kg capacity and (a) 400 g of $BaCO_3$ with 27 g of graphite
(b) 1230 g of $BaCO_3$ were stirred in.

The raw material was then crushed and analysed:

| | a | b |
|---|---|---|
| % Si | 72.6 | 70.7 |
| % Al | 0.91 | 0.83 |
| % Ca | 0.16 | 0.10 |
| % Ba | 0.8 | 2.5 |
| Remainder Fe | | Remainder Fe |

Samples of the cast iron were taken as described under Example 1, and the carbide formation was measured:

| | | |
|---|---|---|
| Ladle 1 | Sample a | 2 mm |
| | Sample b | 1.5 mm |
| Ladle 2 | Sample a | 3 mm |
| | Sample b | 1.5 mm |
| Ladle 3 | Sample a | 2 mm |
| | Sample a | 1 mm |
| Ladle 4 | Sample b | 1 mm |
| | Sample b | 1 mm |

We claim:

1. In a ferrosilicon or silicon inoculant alloy of the type consisting essentially of ferrosilicon or silicon alloyed with secondary components, for the manufacture of cast iron with lamellar, compact or spheroidal graphite, the improvement wherein said secondary components consist essentially of (a) between 0.1 and 10% of barium and/or zirconium in free or combined form or a mixture thereof,
(b) less than 2.0% of aluminum and
(c) less than 0.3% of calcium.

2. An inoculant alloy as claimed in claim 1, wherein the barium and/or zirconium content is 0.4–1.5%.

3. An inoculant alloy as claimed in either of claims 1 and 2, wherein the aluminum content is less than 1.0%.

4. An inoculant alloy as claimed in any of claims 1 to 3, wherein the calcium content is less than 0.1%.

5. An inoculant alloy as claimed in any of claims 1 to 4, wherein the barium and/or zirconium are present in part in a non-metallic form in the alloy.

6. An inoculant alloy as claimed in any of claims 1 to 5, wherein the barium and/or zirconium are present in an oxidic form in the alloy.

* * * * *